United States Patent [19]

Schreitz

[11] 4,448,544

[45] May 15, 1984

[54] METHOD AND APPARATUS TO DIGITALLY DISPLAY THE TIME OF DAY

[76] Inventor: Richard G. Schreitz, 2020 Brooks Dr., Apt. 203, Forestville, Md. 20747

[21] Appl. No.: 212,069

[22] Filed: Dec. 2, 1980

[51] Int. Cl.[3] ..... G04C 17/02

[52] U.S. Cl. ..... 368/239; 368/241; 368/242; 368/82; 368/83

[58] Field of Search ..... 368/239, 241, 242, 82, 368/83, 84; 340/756

[56] References Cited

U.S. PATENT DOCUMENTS 4,194,352 3/1980 Terzian .

4,264,966 4/1981 Terzian ..... 368/82

*Primary Examiner*—Ulysses Weldon

*Attorney, Agent, or Firm*—Cushman, Darby & Cushman

[57] ABSTRACT

A simplified dual format time display provides easy-to-read "count up" and "count down" digital readouts which indicate either the hour and the minutes after the hour or the next hour and the minutes before the next hour using conventionally positioned hour and minute digits of substantially equal size. In the "count down" mode, a minus sign appears immediately to the left of the minute digits to provide a readily interpreted algebraic representation of the number of minutes which must yet elapse before the next hour arrives.

5 Claims, 4 Drawing Figures

Detailed Description of
$I_1$ - $I_5$

Detailed Description of
Inverting Amplifier (Inv Amp)

j = hours past midnight or noon
k = minutes past j
If k ≤ 30,
h = j
m = k
If k > 30,
h = (j mod 12) + 1
m = k - 60
V1 is L if lmi = Ox
V2 is H if m = 30
V3 is H if m = 00 or m = 30
V4 is H if 31 ≤ k ≤ 59
V5 is H if h = 12
M = square wave, 1 cycle/minute
a = 29 minutes
b = 31 minutes
S = square wave
Generation of L2
Generation of L1
12 00 1 00
Z1 1/2 7473
Z2 1/2 7473
Z3 1/2 7451
Z4 74192
Z5 74192
Z6 74192
Z7 74192
Z8 1/2 7473
Z9 1/2 7473
7448
Inv Amp

METHOD AND APPARATUS TO DIGITALLY DISPLAY THE TIME OF DAY

BACKGROUND OF THE INVENTION

Certainly one of the most outstanding features of a digital timepiece is the relative ease with which a person viewing the timepiece can communicate the time to a person or persons who cannot see it, as in the case of a radio announcer broadcasting the time over the air. A digital timepiece has one of the same advantages over an analog timepiece that a digital calculator has over a slide rule: the reading process is instantaneous—it does not require mental labelling of fiducial marks.

However, from 31 through 59 minutes after the hour, this advantage is offset if the viewer chooses to express the time in the second of the two formats listed below. A conversion will be necessary.

"$m_1$ minutes after $h_1$", Format where $m_1$ is the minutes after the current hour and $h_1$ is the current hour.

"48 minutes after 7". Example

"$m_2$ minutes before $h_2$", Format where $m_2$ is the minutes before the next hour and $h_2$ is the next hour.

"12 minutes before 8". Example

A need clearly exists, therefore, for a simple and aesthetically pleasing method of representing the time of day so that those who prefer the second format during the last 29 minutes of the hour will not be required to devise and execute a conversion procedure.

BRIEF SUMMARY OF THE INVENTION

The timepiece described herein presents the time of day in each of two distinct formats. The first format, which is used from 0 through 30 minutes after the hour, includes the hour and the minutes after the hour. The second format, which is used from 31 through 59 minutes after the hour, includes the next hour, a minus sign, and the minutes before the next hour.

DETAILED DESCRIPTION

Figure 1:
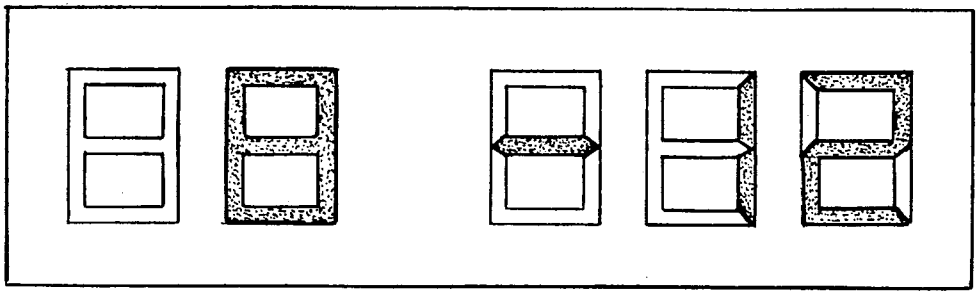
FIG. 1 is a digital display "8–12" (7:48)
Figure 3:
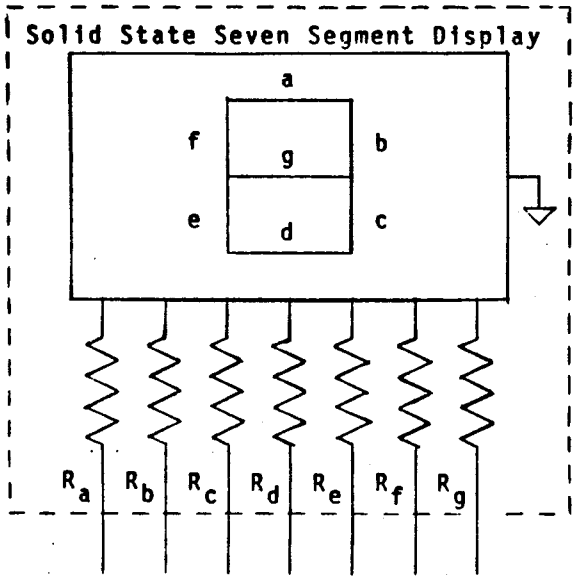
FIG. 3 is a detailed description of the display devices $I_1$ through $I_5$.
Figure 4:
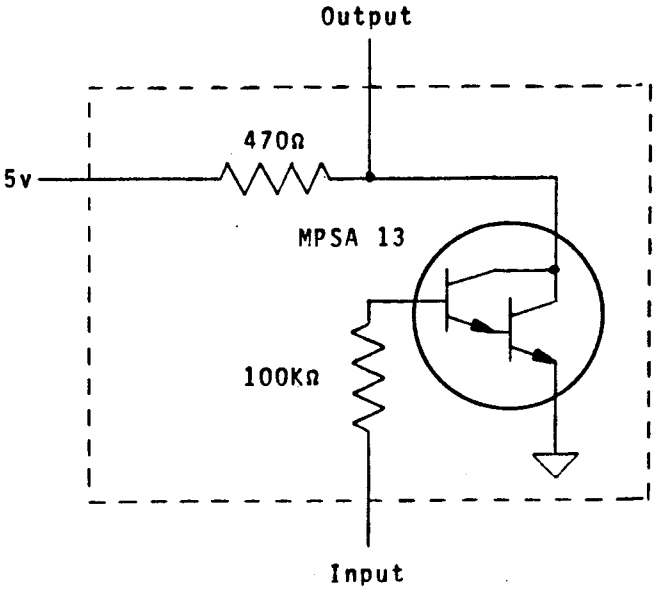
FIG. 4 is a detailed description of the inverting amplifier.
Figure 2:
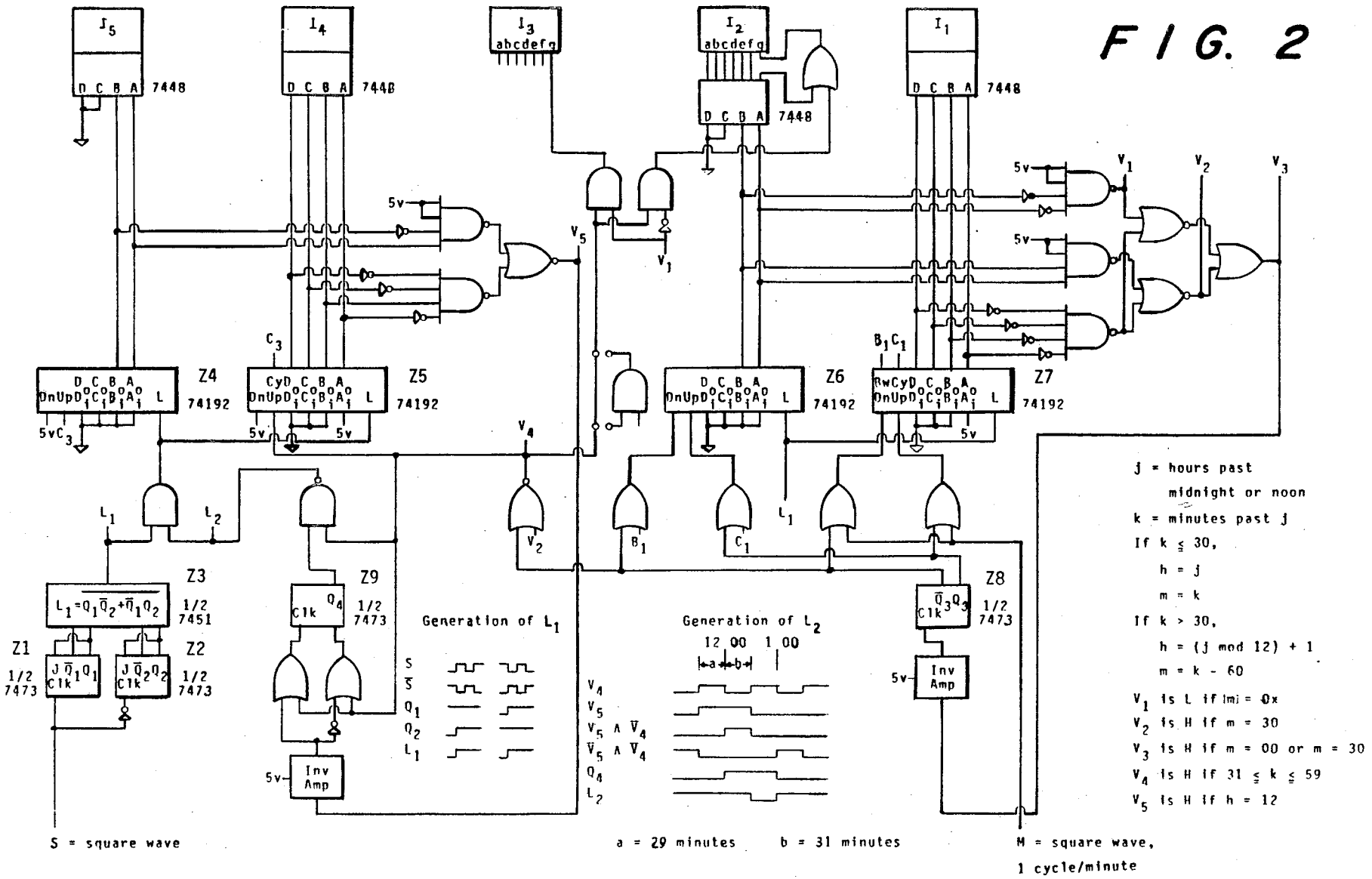
FIG. 2 is a schematic diagram of the embodiment.

The digital display device $I_5$ through $I_1$ (See FIG. 2) are identical (See FIG. 3) and are used to display the time of day in ech of two distinct formats. $I_5$ and $I_4$ are used to display the hour (or the next hour) and $I_2$ and $I_1$ are used to display the minutes after the hour (or the minutes before the next hour). Leading zeros, which would normally appear in $I_5$ and $I_2$ are suppressed. This is accomplished by grounding the appropriate pin in the $I_5$ and $I_2$ 7448 decoder/drivers (pin 5). When the next hour and the minutes before the next hour are displayed, a minus sign is presented in $I_3$ (if the minutes display requires two digits) or in $I_2$ (if the minutes display requires only one digit).

Given a square wave S with a frequency of 1 to 60 Hz, two flip flops Z1 (½ 7473) and Z2 (½ 7473) and a two-wide two-input AND-OR-INVERT gate Z3 (½ 7451) produce the signal $L_1$, which is low for the first half cycle and high thereafter. (See "Generation of $L_1$" in FIG. 2.)

When $L_1$ is low, all four of the up/down decade counters Z4 through Z7 (74192's) are loaded with the following values:

| | | |
|---|---|---|
| Z4 | tens of hours counter | 0 |
| Z5 | hours counter | 1 |
| Z6 | tens of minutes counter | 0 |
| Z7 | minutes counter | 1 |

The direction of counting of the decade counters is determined by which count input is pulsed (Dn or Up) while the other count input is held high. Z4 and Z5 are used as up counters only—their respective down count inputs are permanently held high. Z6 and Z7, however, serve, in unison, either as up counters or as down counters, depending on the signal $Q_3$ generated in flip flop Z8 (½ 7473).

Initially, $Q_3$ is low. The Z6 and Z7 down count inputs are held high, and Z6 and Z7 serve as up counters. Square wave M, with a frequency of 1 cycle/minute, is applied to the Z7 up count input. In the up count mode, each cycle of M will cause the Z7 count, registered at pins $D_0$ $C_0$ $B_0$ $A_0$, to be incremented by 1, until the need arises to represent a number greater than 9. When this point is reached, the Z7 carry flag $C_1$ will be set high and the Z7 count will be set to 0. The Z7 carry flag $C_1$ is applied to the Z6 up count input. Each time $C_1$ is set high, the Z6 count will be incremented by 1.

When the Z6–Z7 count is equal to 30 (i.e. when the Z6 and Z7 counts are equal, respectively, to 3 and 0), $V_2$ will be set high, $V_3$ will be set high, $Q_3$ will be set high, the Z6 and Z7 up count inputs will be set high, and Z6 and Z7 will become down counters. Square wave M will be applied to the Z7 down count input. In the down count mode, each cycle of M will cause the Z7 count to be decremented by 1, until the need arises to represent a number less than 0. When this point is reached, the Z7 borrow flag $B_1$ will be set high and the Z7 count willl be set to 9. The Z7 borrow flag $B_1$ is applied to the Z6 down count input. Each time $B_1$ is set high, the Z6 count will be decremented by 1.

On the next cycle, the Z6–Z7 count will drop from 30 to 29, $V_2$ will be set low, and $V_4$ will be set high. The transition of $V_4$ from low to high increments the Z4–Z5 count and, as long as $V_4$ remains high, a minus sign will appear in $I_3$ (if the minutes display requires two digits) or in $I_2$ (if the minutes display requires only one digit).

When the Z6–Z7 count reaches 0, $V_3$ will again be set high, $\overline{Q}_3$ will be set high, $V_4$ will be set low, the minus sign will disappear, and Z6 and Z7 will again become up counters.

When the Z4–Z5 count reaches 12, $V_5$ is set high and a procedure is initiated to insure that when $V_4$ again rises from low to high, normally the signal to increment the Z4–Z5 count, $L_2$ will be set low and the Z4–Z5 count will be reset to 1. (See "Generation of $L_2$" in FIG. 2.)

The two signals $V_5 \wedge \overline{V}_4 (=\overline{\overline{V}_5 \wedge V_4})$ and $\overline{V}_5 \wedge \overline{V}_4 (=\overline{\overline{V}_5 \wedge V_4})$ are applied, respectively, to the CLOCK and CLEAR inputs of flip flop Z9 (½ 7473) to create a signal $Q_4$ which rises from low to high at 1200 and falls from high to low at 100. (Note: The CLOCK and CLEAR functions are triggered by logical lows.) $Q_4$ and $V_4$ are applied as inputs to a two-wide AND-INVERT gate, the output of which is the signal $L_2$. At 1231, when $V_4$ rises from low to high, $L_2$ will fall from high to low as required.

What is claimed is:

1. A digital time display system which comprises:

first digital display means for displaying digits representing hour time values;

second digital display means disposed to the right side of said first display means, said second digital display means being provided for displaying digits representing minute time values;

third digital display means disposed between said first and second display means, said third digital display means being provided for displaying a minus sign when activated; and timing control means connected to said first second and third display means for selectively causing time displays to occur in one of the following two formats:

(a) in succession from left to right, the current hour and the number of elapsed minutes after that hour; and (b) in succession, from left to right, the next hour to subsequently become the current hour and the number of minutes which must yet elapse before that event is to occur.

2. A digital time display system as in claim 1 wherein said first and second digital display means display substantially the same sized digits.

3. A digital time display system as in claim 1 wherein said first, second and third digital display means are each substantially identical seven segment digital display devices.

4. A digital time display system as in claim 1 wherein said timing control means includes means effective to select the first-mentioned display format during approximately the first 30 elapsed minutes after the current hour and to select the other display format during approximately the second 30 elapsed minutes after the current hour.

5. A digital time digital method which comprises:

during approximately the first half of each hour, digitally displaying the current hour to the left of a digital display of the number of elapsed minutes after that hour; and during approximately the second half of each hour, digitally displaying the next hour to subsequently become the current hour to the left of a digital display of the number of minutes which must yet elapse before that event is to occur while also displaying a minus sign between the displayed hour and minute values.

* * * * *